US005372029A

United States Patent [19]

Brandes

[11] Patent Number: 5,372,029

[45] Date of Patent: Dec. 13, 1994

[54] METHOD OF MONITORING THE QUALITY OF AN OBJECT OR STATE

[76] Inventor: Bernd Brandes, Mühlengrund 4, W-2325 Grebin, Germany

[21] Appl. No.: 764,326

[22] Filed: Sep. 23, 1991

[30] Foreign Application Priority Data

Sep. 22, 1990 [DE] Germany ..... 4030108

[51] Int. Cl.[5] ..... G08B 29/00

[52] U.S. Cl. ..... 73/1 R; 340/511

[58] Field of Search ..... 73/1 R, 1 H; 340/511

[56] References Cited

U.S. PATENT DOCUMENTS

| | | | |
|---|---|---|---|
| 3,582,773 | 6/1971 | Karl . | |
| 3,995,478 | 12/1976 | Wilhelm, Jr. . | |
| 4,270,041 | 5/1981 | Pleyber . | |
| 4,514,720 | 4/1985 | Oberstein et al. | 340/511 |
| 4,695,965 | 9/1987 | Fujita et al. . | |
| 4,828,787 | 5/1989 | Distler et al. . | |
| 4,862,385 | 8/1989 | Fujita et al. . | |
| 5,084,696 | 1/1992 | Guscott et al. | 340/526 |
| 5,084,825 | 1/1992 | Kelly et al. | 340/511 |
| 5,161,405 | 11/1992 | Macqueene | 73/1 R |

FOREIGN PATENT DOCUMENTS

| | | |
|---|---|---|
| 1599340 | 7/1970 | France . |
| 2175952 | 10/1973 | France . |
| 1574146 | 11/1972 | Germany . |
| 3808128 | 9/1989 | Germany . |

*Primary Examiner*—Robert Raevis

*Attorney, Agent, or Firm*—Spencer, Frank & Schneider

[57] ABSTRACT

A method and apparatus is provided for monitoring a variable in a system. Actual values of the variables are sensed to produce sensed values. An initial threshold is set below an initially sensed value by a predetermined difference. Thereafter, the threshold is selectively maintained constant and adjusted to follow below the sensed values by a difference which is a function of the sensed values if the sensed values remain constant or increase, with the threshold remaining constant if the sensed values decreases. The threshold is compared with the sensed values and an indication of an unsatisfactory quality is provided if the sensed values fall below the threshold.

18 Claims, 4 Drawing Sheets

METHOD OF MONITORING THE QUALITY OF AN OBJECT OR STATE

CROSS-REFERENCE TO RELATED APPLICATIONS

The present application claims the rights of priority with respect to application Ser. No. P 40 30 108.7 filed Sep. 22, 1990 in Germany, the subject matter of which is incorporated herein by reference.

BACKGROUND OF THE INVENTION

This invention relates to a method and an apparatus for monitoring a variable in a system.

Prior art methods of this type include, periodically or continuously, sensing a value of the variable, and comparing the sensed value, with a constant threshold. If the sensed value falls below the threshold, the quality of the variable, and hence of the system is indicated as no longer satisfactory.

Examples where methods of this type are useful are monitoring insulation between two-walled pipelines, or checking of cable shafts for moisture. The threshold below which unsatisfactory quality is indicated is generally a function of a certain intent, requirement, rule, or predetermined value.

In a known system of this type, the threshold is permanently set for each monitoring task in stepping switches or potentiometers, either at a factory, or manually during use at the discretion of a user. The threshold is determined in each case from an understanding of a required quality of the system in dependence upon the type of sensor used to measure the variable.

In certain circumstances there exists a discretionary margin or a difference of opinion regarding the threshold. For example, a person responsible for the quality may think the threshold is too high, while another person who could possibly be harmed, may think the threshold is too low. Thus it is possible that identical circumstances could result in a complaint from one user that a report of unsatisfactory quality comes too late while another user complains that the report comes too early.

SUMMARY OF THE INVENTION

It is an object of the present invention to provide a method and an apparatus for monitoring a variable in a system in which quality checks are better adapted to practical circumstances and in which discretionary ranges and discrepancies are substantially avoided.

The above and other objects are accomplished according to one aspect of the invention by the provision of a method for monitoring a variable in a system comprising: sensing actual values of the variable over time to produce sensed values; setting an initial threshold below an initially sensed value by a predetermined amount and thereafter selectively maintaining the threshold constant and adjusting the threshold to follow below the sensed values by an amount which is a function of the sensed values if the sensed values remain constant or increase, with the threshold remaining constant if the sensed values decrease; comparing the threshold with the sensed value; and indicating an unsatisfactory quality if the sensed values fall below the threshold.

In accordance with a further aspect of the invention there is provided an apparatus for monitoring a variable in a system comprising: sensing means for sensing momentary values of the variable over a period of time; threshold generating means for setting an initial threshold below an initially sensed value by a predetermined amount and thereafter selectively maintaining the threshold constant and adjusting the threshold to follow below the sensed value by an amount which is a function of the sensed value if the sensed value remains constant or increases, with the threshold remaining constant if the sensed value decreases; a comparator having two inputs connected to said sensing means and to said threshold generating means, respectively, and a comparison output, for comparing a momentary sensed value with the threshold; and indicating means connected to said comparison output for indicating when the sensed value is at or below the threshold.

In the method and the apparatus according to the invention, an unsatisfactory quality is not indicated at the beginning of the monitoring period, regardless of the initial sensed value. Instead, the initially sensed value is accepted as normal. The threshold is set, for example, below the initially sensed value by a predetermined amount. This may be done automatically.

During the course of monitoring, the threshold is determined according to a function of the sensed value. If the sensed value is sufficiently greater than the threshold, the threshold is correspondingly increased, but otherwise the threshold remains constant. The threshold is increased in such a manner that it remains below the sensed value by a certain absolute or relative amount. If the sensed value decreases the threshold does not decrease, but remains constant. The threshold does not decrease unless a setting means is activated. Thus the threshold is always automatically adapted to the sensed value and is not a constant.

According to one embodiment of the invention, the sensed value never exceeds the threshold by more than an approximately constant amount. In another embodiment, the threshold never falls below a predetermined fraction of a maximum value of sensed parameter.

Only when the sensed value falls below the threshold will an unsatisfactory quality be indicated. One advantage of this method is that in many cases it is no longer necessary to have a person present as a constant monitor. With such an adaptive threshold, reports about unsatisfactory quality which in fact do not exist are substantially avoided. Instead, a sudden drop in quality, which could later cause damage, is detected quickly so that appropriate measures can be initiated. It is thus possible to also monitor a declining or bad state regarding its further development. In the general case, the threshold value represents a qualitative state that is still acceptable.

The method and apparatus operate under a premise that a condition might not be ideal, but if it does not get worse it can still be considered acceptable. The method thus opens new applications for existing devices for monitoring the quality or state of a system. A manually confirmed or later occurring better value is defined as a "GOOD" state.

The invention will now be described and explained in greater detail with reference to the drawing figures.

DETAILED DESCRIPTION OF PREFERRED EMBODIMENTS

Figure 1:
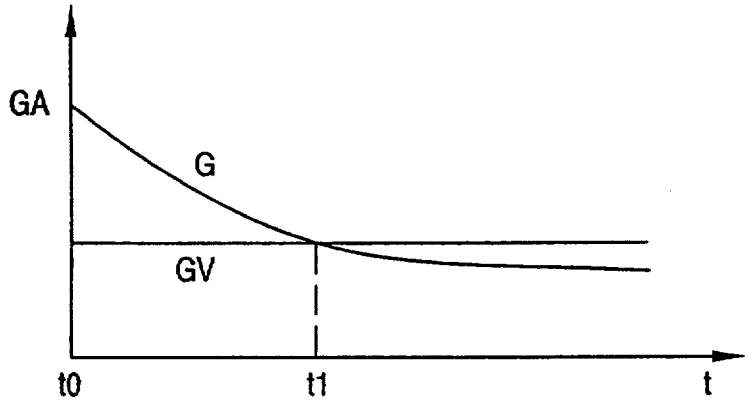
FIG. 1 PRIOR ART
FIG. 1 is a graph illustrating a prior art quality control method.

FIG. 1 is a graph illustrating a prior art quality control method. Curves for a sensed value G of a parameter of, or relating to, a system or an object, and a constant threshold GV are shown as a function of time t. At time t1 an unsatisfactory quality will be indicated because sensed value G falls below threshold GV. Unsatisfactory quality is assumed to exist in any case when sensed value G lies below threshold GV.

Figure 2:
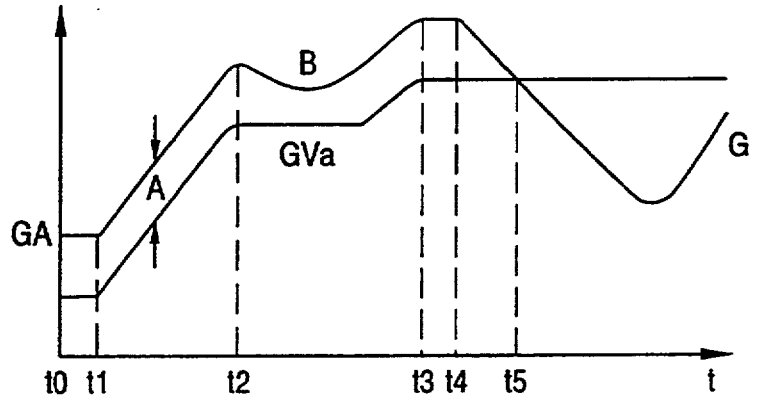
FIGS. 2 and 3 are graphs illustrating the method according to the invention.

FIG. 2 shows a method according to the invention. Sensed value G has an initial value GA at an initial time t0. A threshold GVa is automatically adapted to lie below initial value GA, of sensed value G, by an amount A. Between times t0 and t1 sensed value G remains constant, so threshold GVa also remains constant. Between times t1 and t2, sensed value G is increasing. Threshold GVa increases according to a function of sensed value G, such that the amount A at which threshold GV lies below sensed value G remains approximately constant. At time t2 sensed value G experiences a decrease B. While sensed value G decreases, threshold GVa remains constant since the threshold never decreases unless a setting means is activated. Since sensed value G does not fall below threshold GVa, a report of unsatisfactory quality is not given. At time t4 sensed value G again decreases. At time t5 a report of unsatisfactory quality is given since sensed value G has fallen below threshold GVa, and since such a decrease would with great probability later cause damage. Never allowing sensed value G to exceed threshold GVa by more than a constant amount A is appropriate for measuring tasks involving a linear measuring value, for example for the fill level of a container which is allowed to rise but must never drop by more than a given amount.

Figure 3:
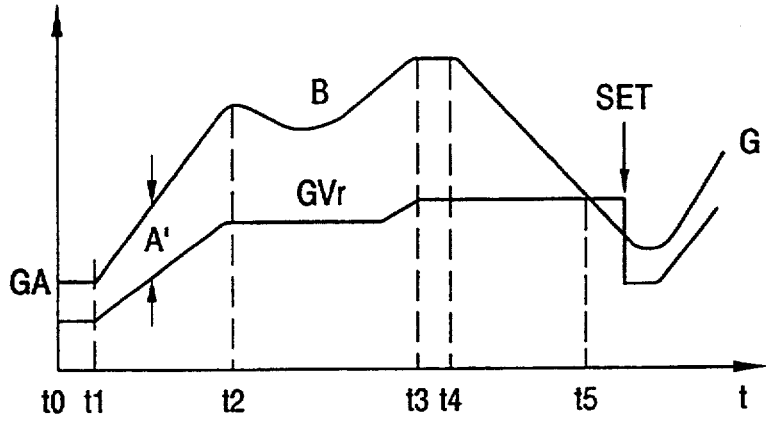

Other measuring values often produce logarithmic curves which are correspondingly better considered as proportions. FIG. 3 thus shows an alternative embodiment of the invention wherein the function operates so that a threshold GVr never falls below a predetermined fraction (for example 50% of the maximum sensed of value G) as is appropriate for logarithmic curves. In FIG. 3, the respective relative difference between sensed value G and threshold GVr is marked A'. Here again, threshold GVr changes only as sensed value G changes in the direction of improvement. Therefore, sensed value G intersects threshold GVr only if there is a correspondingly great drop in the variable, such as at time t5. After indicating or reporting the unsatisfactory quality at time t5, the threshold may be reduced or set to a lower value so that the threshold again begins at the desired distance A (FIG. 2) or A' (FIG. 3) below curve G.

Figure 4:
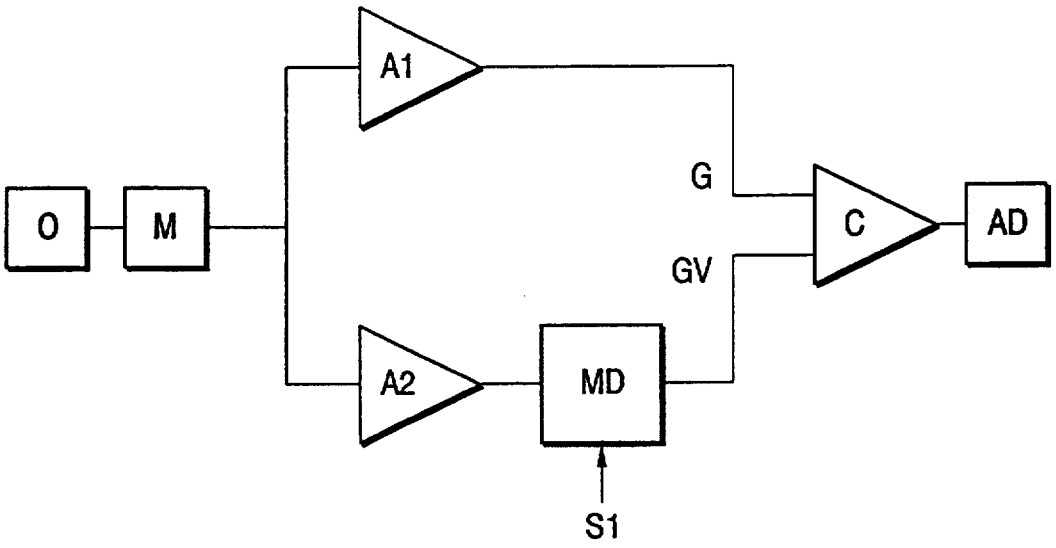
FIG. 4 is a block diagram representation of one embodiment of an apparatus according to the invention.

FIG. 4 shows an apparatus according to the invention which can implement the methods shown in FIGS. 2 and 3. A sensing (or measuring) device M produces the sensed value which is a momentary value of the variable O, or relating to a system or object O. Sensed value G (or F1) is fed to one input of a comparator C by way of a function amplifier A1. Threshold GV (or F2), which is a function of sensed value G, is fed to another input of the comparator C by way of another function amplifier A2 and a memory device MD. An output of comparator C is connected to an indicator device AD, which is, for example, an indicator or a device for evaluating the information.

Memory device MD produces threshold GV by decreasing sensed value G by an adjustable base value, which can be influenced with respect to the function to be performed. Memory device MD is associated with a setting means S1 which can be configured for example as a button, handle, or key, and is designed so that setting or adjustment of threshold GV is only permitted by activation of setting means S1.

Function amplifiers A1, A2 can be configured as circuits, amplifiers, or the like, for producing sensed value G and threshold GV. Function amplifiers A1, A2 are preferably adjustable to characteristic curves and gains, for example, a factor of 1, 2 or the like. Thus, signal output from measuring device M may be amplified by function amplifier A1 before being fed to one input of comparator C. Also, the signal output from measuring device M may be amplified by function amplifier A2 before being fed to an input of memory device MD.

When, for example, monitoring of an object O begins, an operator would actuate setting means S1. With this intentional setting, or actuation, threshold GV is adapted to sensed value G of object O. The apparatus may be given such dimensions that actuation of setting means S1 at any time when monitoring of object O begins defines threshold GV for sensed value G as a normal value. For example, actuation of setting means S1, would automatically set thresholds GVa or GVr of FIGS. 2 or 3, respectively, somewhat below sensed value G. Setting means S1 may thus be configured as a set key for performing a predetermined, preset instruction or for setting the difference A, A'.

Setting means S1 or another setting means may be configured to turn off an automatic system for updating the threshold. The corresponding curve for such a static condition is shown as GVs in FIG. 7.

Figure 5:
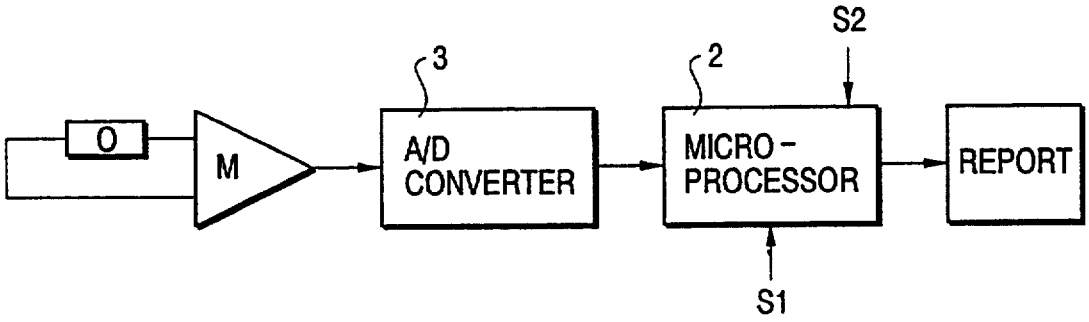
FIG. 5 is a block diagram representation of another embodiment of an apparatus according to the invention which employs a microprocessor.
Figure 6:
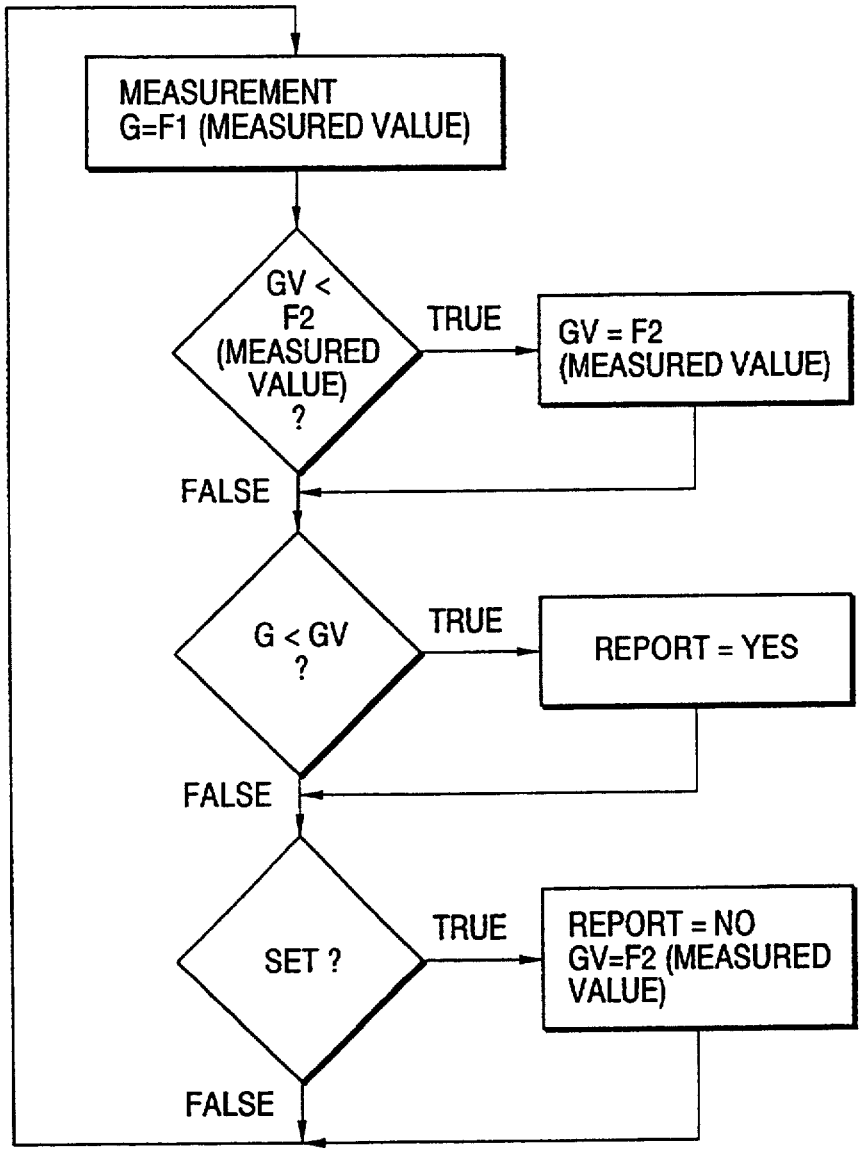
FIG. 6 is a flow chart indicative of the instructions executed by the microprocessor shown in FIG. 5.

FIG. 5 shows an apparatus according to another embodiment of the invention in which the output of sensing device M is fed to an analog to digital (A/D) converter 3 which is connected to a microprocessor system 2 that performs the functions of all the components to the right of sensing device M in FIG. 4. FIG. 6 shows a flow chart which describes the instructions to be executed by microprocessor system 2. Microprocessor system 2 produces threshold value F2 as a given function of measured or sensed value F1 or G, as shown in FIG. 6, and much in the same manner as described in relation to MD in FIG. 4. Thus, threshold GV assumes the value of produced threshold F2 if F2 is greater than threshold GV. If F2 is less than or equal to GV, GV stays constant, unless microprocessor system 2 detects that sensed value G has fallen below threshold GV ($G<GV$ condition is true), in which case an alarm may be activated. Microprocessor system 2 may be provided with a second setting means which, if actuated after the alarm is activated, causes a just measured sensed value G, which was considered a "poor value" to be defined as a "good value," with further measurements being based on the latter.

Figure 7:
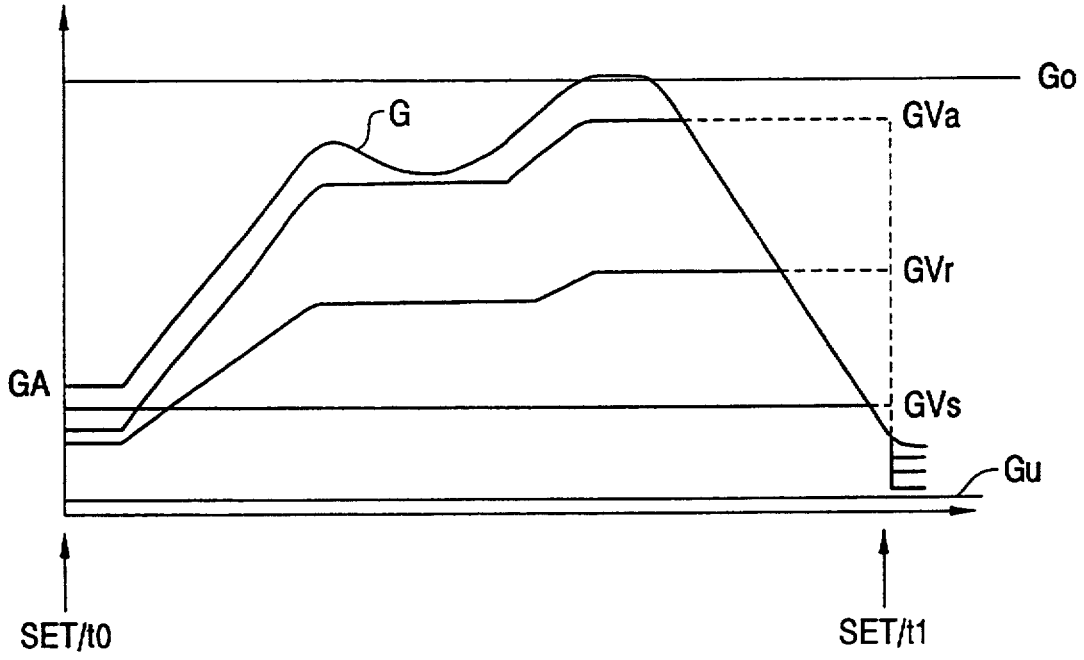
FIG. 7 is a graph showing two different thresholds according to the invention, and a non-adaptive type of threshold.

FIG. 7 shows a curve G for the sensed value, and curves for thresholds GVa and GVr according to FIGS. 2 and 3, respectively, as well as curve GVs for a threshold value that is not adapted automatically. FIG. 7 further shows upper limit Go and a lower limit Gu which constitute a band-width limitation for threshold GV. Threshold GV can be constrained to always be greater than lower limit Gu and always be less than upper limit Go. Upper and lower limits can be used to exclude extreme states from regulation.

For example if insulation is being monitored which is under water and therefore wet throughout, a value will occur at some time which, as in a saturated state, cannot be reduced any further. It would be wrong to permit threshold GV to fall below the saturation level. A value which is determined purely physically or empirically would be utilized for lower limit Gu. This value constitutes a limit which is acceptable as always workable and leaves no further discretionary margin. Gu and Go would be equivalents of the prior art uppermost and lowermost settable thresholds—although in the solution of the present invention, more extreme values are employed.

An example of how upper limit Go could be set is given by the following conditions. At room temperature, a resistance value of 10 MOhm for insulation is presently considered to be a universally acceptable value. However, it is conceivable that further drying of the insulation could produce a real value of 1 GOhm for sensed value G. It would therefore be wrong, to permit threshold GV to reach a value of 800 MOhm (as for example 80% of 1 GOhm). It would then be appropriate, for example, to set upper limit Go at 8 MOhm (that is 80% of the universally acceptable value, 10 MOhm).

Figure 8:
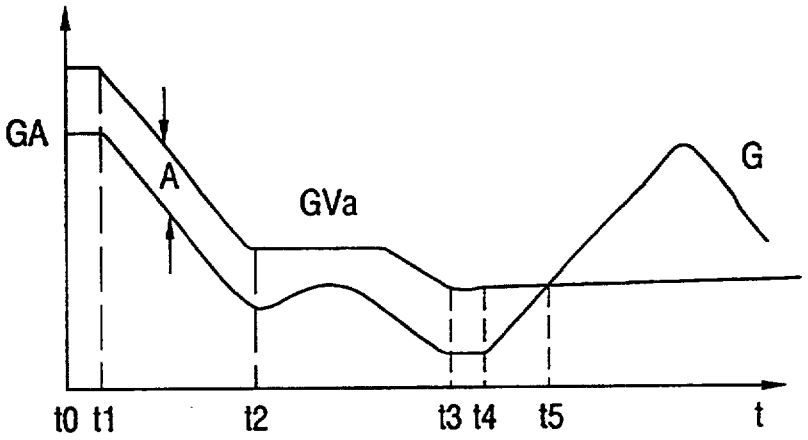
FIG. 8 corresponds to a reverse situation according to FIGS. 2 wherein the threshold is set above the sensed value of the variable and an unsatisfactory quality is indicated is the sensed values rise above the threshold according to another aspect of the invention.

The method according to the invention has been described so that a decrease in the sensed value always represents a decrease in quality. The present invention is also intended to encompass equivalent methods and apparatus for monitoring tasks where an increase in the sensed value is associated with a decrease in quality. This is illustrated in FIG. 8 which correspond to the reverse situation of FIG. 2. That is, if the method according to the invention were applied to monitoring humidity, for example, and increasing humidity (or moisture) were considered to constitute a decrease, then a momentary value G indicates moisture which should not exceed a threshold value GV. In the correct state then, G lies below GV and in the case of unsatisfactory quality or a failure condition, G exceeds GV. An equivalent situation is represented by FIG. 2 if sensed value G represented dryness instead of moisture. Since a decrease in dryness is equivalent to an increase in humidity, a decrease in dryness will represent a decrease in quality. The apparatus illustrated in FIG. 4, for example, may be used for setting the threshold above the sensed values according to FIG. 8 by appropriately configuring memory device MD.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A method for monitoring a variable in a system comprising:

sensing actual values of the variable over time to produce sensed values of the variable;

setting an initial threshold below an initially sensed value of the variable by a predetermined amount and thereafter selectively maintaining the threshold constant and adjusting the threshold to follow below the sensed values by an amount which is a function of the sensed values if the sensed values remain constant or increase, with the threshold remaining constant if the sensed values decrease;

comparing the threshold with the sensed values; and indicating an unsatisfactory quality if the sensed values fall below the threshold.

2. A method as defined in claim 1, further comprising setting the threshold to one of a predetermined and predeterminable value below the sensed values at any given time.

3. A method as defined in claim 1, wherein said setting step includes adjusting the predetermined amount below the initially sensed value at which the initial threshold is set.

4. A method as defined in claim 1, wherein said adjusting step includes adjusting the threshold so that the threshold never falls below a predetermined fraction of a maximum sensed value.

5. A method as defined in claim 1, further comprising maintaining the threshold above a lower limit.

6. A method as defined in claim 1, further comprising maintaining the threshold below an upper limit.

7. An apparatus for monitoring a variable in a system comprising:

sensing means for sensing momentary values of the variable over a period of time;

threshold generating means for setting an initial threshold below an initially sensed value by a predetermined amount and thereafter selectively maintaining the threshold constant and adjusting the threshold to follow below the sensed value by an amount which is a function of the sensed value if the sensed value remains constant or increases, with the threshold remaining constant if the sensed value decreases;

a comparator having two inputs connected to said sensing means and to said threshold generating means, respectively, and a comparison output, for comparing a momentary sensed value with the threshold; and indicating means connected to said comparison output for indicating when the sensed value is at or below the threshold.

8. An apparatus as defined in claim 7, wherein said threshold generating means adjusts the threshold so that the sensed value never exceeds the threshold by more than an approximately constant value.

9. An apparatus as defined in claim 7, wherein said threshold generating means adjusts the threshold so that the threshold never falls below a predetermined fraction of the sensed value.

10. An apparatus as defined in claim 7, wherein said threshold generating means includes setting means which, when activated, reduces the threshold by a predetermined amount.

11. An apparatus as defined in claim 7, including a microprocessor for evaluating the comparison output and the sensed value.

12. A method for monitoring a variable in a system comprising:

sensing actual values of the variable over time to produce sensed values of the variable;

setting an initial threshold above an initially sensed value of the variable by a predetermined amount and thereafter selectively maintaining the threshold constant and adjusting the threshold to follow above the sensed values by an amount which is a function of the sensed values if the sensed values remain constant or decrease with the threshold remaining constant if the sensed values increase;

comparing the threshold with the sensed values; and indicating an unsatisfactory quality if the sensed values fall above the threshold.

13. A method as defined in claim 12, further comprising setting the threshold to one of a predetermined and predeterminable value above the sensed values at any given time.

14. A method as defined in claim 12, wherein said setting step includes adjusting the predetermined value above the initially sensed value at which the initial threshold is set.

15. An apparatus for monitoring a variable in a system comprising:

sensing means for sensing momentary values of the variable over a period of time;

threshold generating means for setting an initial threshold above an initially sensed value by a predetermined amount and thereafter selectively maintaining the threshold constant and adjusting the threshold to follow above the sensed value by an amount which is a function of the sensed value if the sensed value remains constant or decreases with the threshold remaining constant if the sensed value increases;

a comparator having two inputs connected to said sensing means and to said threshold generating means, respectively, and a comparison output, for comparing a momentary sensed value with the threshold; and indicating means connected to said comparison output for indicating when the sensed value is at or above the threshold.

16. An apparatus as defined in claim 15, wherein said threshold generating means adjusts the threshold so that the sensed value never falls below the threshold by more than an approximately constant value.

17. An apparatus as defined in claim 15, wherein said threshold generating means includes setting means which, when activated, increases the threshold by a predetermined amount.

18. An apparatus as defined in claim 15, including a microprocessor for evaluating the comparison output and the sensed value.

* * * * *